United States Patent [19]

Rohr

[11] Patent Number: 4,947,764

[45] Date of Patent: Aug. 14, 1990

[54] PROTECTION AND SECURITY APPARATUS AND METHOD

[75] Inventor: Eduard Rohr, Mägenwil, Switzerland

[73] Assignee: Ed Rohr AG, Mägenwil, Switzerland

[21] Appl. No.: 324,236

[22] Filed: Mar. 15, 1989

[30] Foreign Application Priority Data

Apr. 5, 1988 [CH] Switzerland ..... 1249/88

[51] Int. Cl.[5] ..... E05G 5/02

[52] U.S. Cl. ..... 109/3; 109/11

[58] Field of Search ..... 109/3, 20, 2, 11, 4, 109/17-18; 43/59, 60, 62

[56] References Cited

U.S. PATENT DOCUMENTS

| | | | |
|---|---|---|---|
| 1,428,003 | 9/1922 | Chambers | 109/3 |
| 3,965,027 | 6/1976 | Reeves | 109/3 |

FOREIGN PATENT DOCUMENTS

| | | | |
|---|---|---|---|
| 1494134 | 7/1967 | France | 109/3 |
| 2335895 | 7/1977 | France | 109/3 |
| 1007949 | 10/1965 | United Kingdom | 43/60 |

*Primary Examiner*—Robert L. Wolfe

*Attorney, Agent, or Firm*—Frishauf, Holtz, Goodman & Woodward

[57] ABSTRACT

To enhance or ensure personal security against an attack, threatened attack or believed attack, a flexible drop net, preferably made of ball chain elements (26, 30), connected at nodal points (28) is retained against and/or partly within a dropped or double-wall ceiling (2, 3). The drop net is held against the ceiling by a pull-up or raising chain, preferably also a ball chain (13), and pulled up by a lifting mechanism (18), for example rollers, engageable with a pull chain and operated by a motor, if desired. A triggering mechanism is coupled to a retention rail or plate (5) holding the drop net or at least a portion thereof within the double ceiling, against the drop rail or plate, or thereabove. Upon a triggering impulse being applied to an electromagnet (6), a linkage (7, 9) releases the drop rail or plate, thus dropping the flexible net over an attacker; any other persons, who are also within the range of the net, will likewise be trapped thereunder, without, however, causing injury.

14 Claims, 5 Drawing Sheets

PROTECTION AND SECURITY APPARATUS AND METHOD

The present invention relates to personal security and protection, particularly within a confined space with respect to attack, burglaries, and the like.

BACKGROUND

Security or protection apparatus must have a high degree of reliability, that is, to protect the person or space when required, but not hurting innocent bystanders who may be close to a danger zone.

THE INVENTION

It is an object to provide an apparatus and system to protect areas or spaces subject to criminal acts, such as attacks, breaking-in, burglary, or the like, and which renders an attacking person incapable of further proceeding with an attack while preventing escape, and without endangering the safety or health of innocent third persons.

Briefly, a flexible net is retained in an upper region of the space to be protected, for example within a dropped ceiling. A pull-up or raising structure, for example a ball chain, is coupled the flexible net and, in turn, coupled to a lifting mechanism to lift the net up against the upper region. A triggering mechanism is provided coupled to a retaining element, which retains the net in the upper region to abruptly and suddenly drop the net, for example upon an electrical command which can be triggered by a hidden switch, a voice-actuated command, or the like, thereby releasing the net and dropping it over the attacking person; if any innocent bystanders should be in the same area they, likewise, will be covered by the net. This, however, neither injures nor hurts anyone of the persons so covered.

The method and system has the advantage that a dropping net completely covers people within the space or region to be protected who, therefore, are practically imprisoned thereby. The people so covered by the net are restrained from their freedom of movement, so that they cannot flee or escape; yet, the people so covered are not hurt or injured so that, for example upon erroneous triggering, or by presence of third innocent bystanders within the confined space, third persons are not injured or hurt.

DRAWINGS

DETAILED DESCRIPTION

Figure 1:
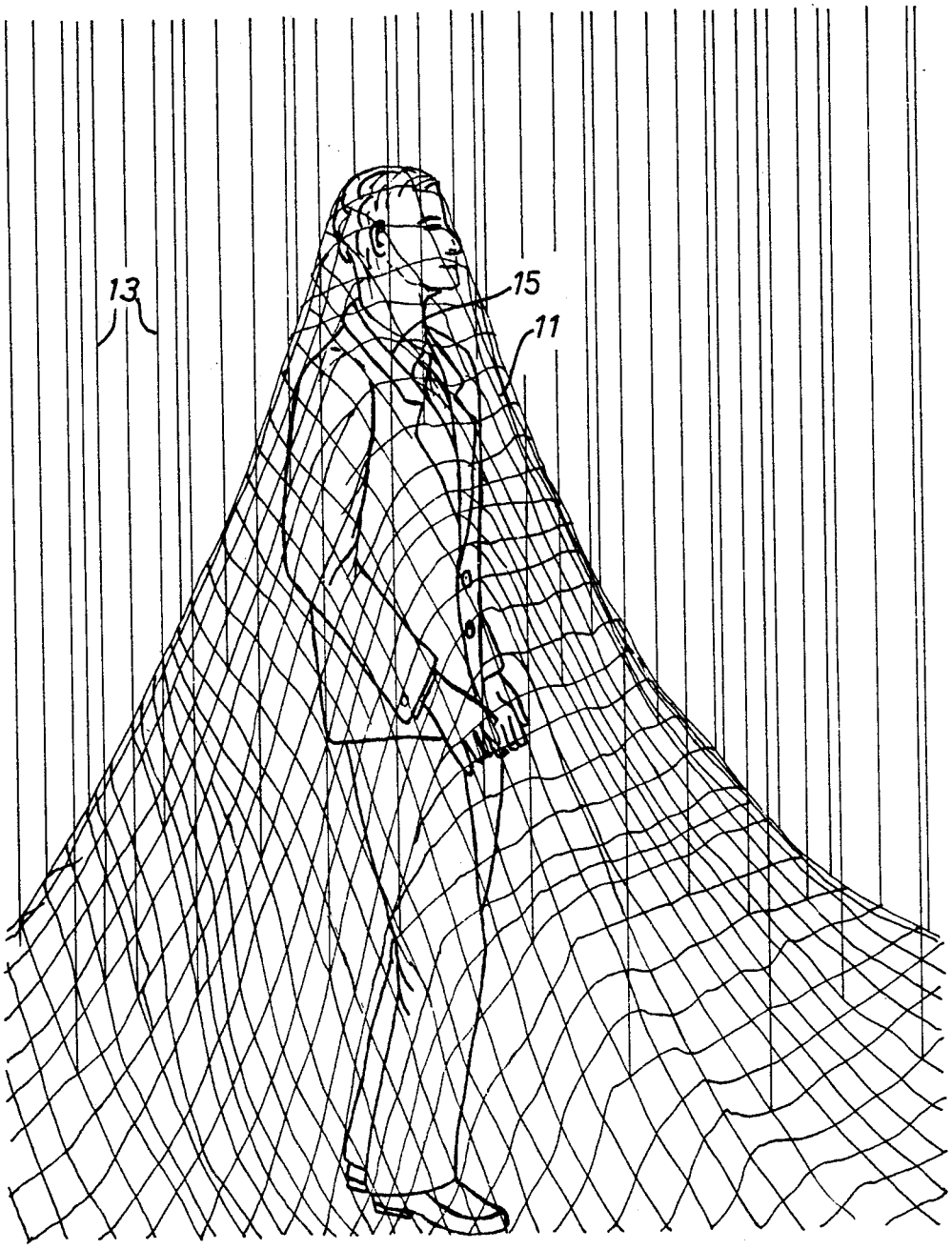
FIG. 1 is a pictorial representation of the net, after it has dropped, and covering a person within a protected space.

The protection apparatus and method is particularly applicable for an interior space, for example a room, within a building. A wide or coarse mesh drop net 11 is held, gathered, collected, for example partly bundled or folded, on the bottom side of a dropped ceiling 2. The drop net 11 is coupled to a release mechanism, which permits the net to drop down towards the floor of the respective space, and to cover any persons within the space. One portion, for example a central portion or holding element of the drop net 11, is continuously coupled to a flexible raising element 13, to permit the net to be raised. The dropped ceiling 2 includes, as known, a plurality of horizontal cover elements 3. In accordance with a feature of the invention, the dropped ceiling 2 is so constructed that vertical duct or channel-like spaces 4 are formed between selected ceiling elements 3. The ceiling elements 3 and the spaces 4 extend, preferably, throughout the entire length and width of the space to be protected, the spaces 4, for example, being located at suitable intervals which may be spaced, as determined by the weight of the net, the ceiling height and the like, in accordance with easily determined dimensions. Holding elements 5 with elastic clamping strips 29 are located in the ducts or channels 4 positioned in the gaps between the ceiling elements 3. The holding elements 5 are pivotably connected, and coupled to a holding and release mechanism, by a linkage 9. The release mechanism, preferably, is an electromagnetic solenoid. Upon movement of the armature 7 in the direction of the arrow A, lever 9, coupled to the release arm 5, is moved upwardly, thus tipping the release arm 5 downwardly in the direction of the arrow B. The solenoid 6 is supported by a lever-and-pivot connection 8.

When the solenoid is energized, pulling the armature 7 upwardly, the holding element 5 releases its block of the space 4. The armature 7 of the electromagnet is pulled into locking condition by a spring 10, so that, as soon as the solenoid 6 is deenergized, the linkage 9 and the blocking element 5 will move into the position shown in FIG. 2. The electromagnet 6 can pivot about the pivot-link 8, to be pivotable about a horizontal pivot axis. The vertical space or duct 4 is formed by two sheet-metal elements 14, which, at their lower ends, can be hooked by hook elements 21 into suitable notches formed in the dropped ceiling elements 3, to retain the dropped ceiling elements in position. The sheet-metal elements 14, thus, can at the same time form hangers for the elements 3. At the upper end, the elements 14 are retained by carrier rails 16 which, in turn, are supported from a side wall 23, as well known in ceiling construction.

A rod 27 is suitably retained in position above the gaps 4 about which a plurality of rollers 18 are located. Each one of the rods 27 is coupled to a motor or a through-rod 27 coupled to a common motor can be provided.

In accordance with a feature of the invention, the drop net 11 is coupled to lifting or raising elements 13. The raising elements, in accordance with a preferred form of the invention, are ball chains; flexible cables or ropes may also be used. Ball chains are preferred since they can be easily controlled, and are freely movable in all directions. The rollers 18, upon energization of the respective pull-up motors, or manually, will pull up the drop net 11 by pulling on the ball chains 13. The rollers 18 preferably are of the sprocket type or formed with notches to permit balls of the ball chains 13 to engage therein. This provides for simple and effective force transfer to raise and stretch the net 11. A portion of the roller chain 13 which upon dropping of the net has to be paid out, is retained in a trough or disk 17. Alternatively, the excess material of the roller chain 13 can be wrapped around the rollers 18 or collected above element 5 at 11*a*.

Figure 3:
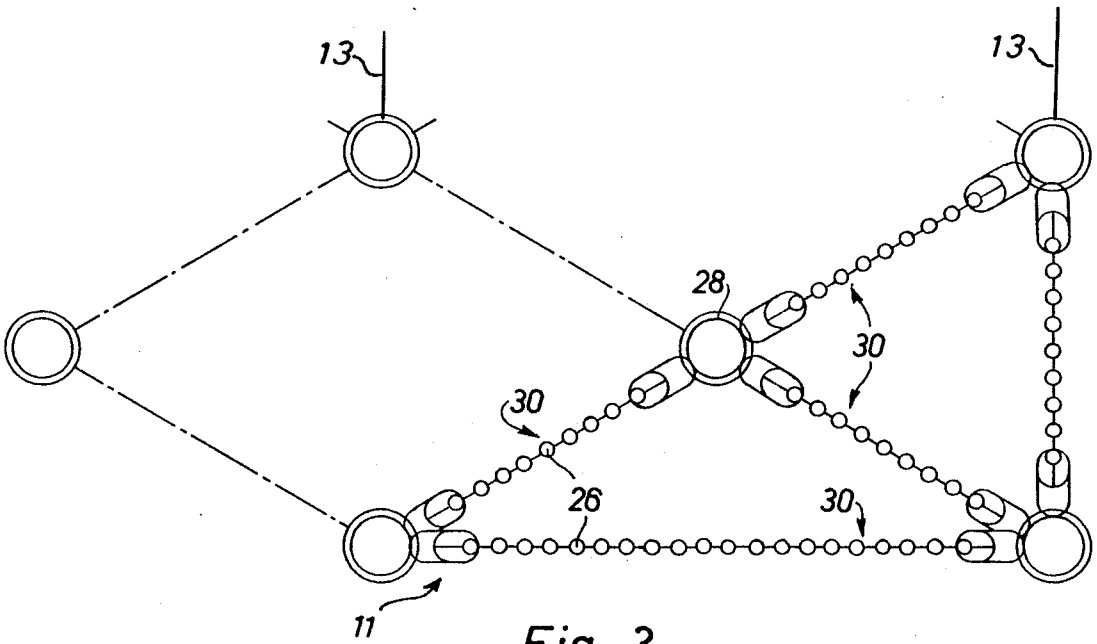
FIG. 3 is a fragmentary plan view of the net structure.

The flexible wide-mesh drop net 11 is best seen in FIG. 3. It is made up of a plurality of connecting elements 30, each formed of ball chain, which are coupled together by nodes or knots 28 to have, in plan view, an essentially diamond or cross-connected mesh structure. The rings 28 loosely interconnect the ball chains so that they can freely move with respect to each other. This permits the elements 30 to be also freely movable with respect to each other. Ball chains are highly resistant to tearing. The balls 26, preferably, are made of metal and, likewise, the rings 28 are preferably made of metal.

The drop net 11 may extend over the entire ceiling or width of the space to be protected or only over a portion thereof, for example over a region close to bank teller cages or the like. It is so dimensioned that, upon dropping, it reaches down to the floor, even if a person is thereunder, see FIG. 1. After dropping, the drop net 11 remains connected to the raising element 13 which, however, at that time will be slack and untensioned.

To protect the space, the drop net 11 is raised until the major portion thereof fits against the lower side of the ceiling elements 3. A portion of the pulled up net can be stored above the drop element 5, in region 11*a*; alternatively, the pull-up chain 13 can pull up the net 11 to the edge of the rim 29 and then release a portion of the chain 13 to be stored in the region 11*a* above the drop element 5. If the net is retained above the drop element 5, it can be held in loose, bunched, bundled or randomly placed position in region 11*a*.

OPERATION

In ordinary position, the interconnected drop net 11 is visible along the cover elements 3. The balls 26 of the ball chain, and the connecting links, all made of metal, can be formed to have a decorative effect. A portion of the ceiling element and/or the raising chain 13 is loosely retained above and behind the drop element 5. As soon as the solenoid 6 is energized, for example by receiving a triggering or release pulse, the armature 7 is moved in the direction of the arrow A, which results in sudden drop of the drop element 5 in the direction of the arrow B. The drop net 11 will drop suddenly and rapidly downwardly—which, particularly due to the weight of a metallic net formed of ball chain elements, will occur rapidly due to the low air resistance. The drop net 11 thus drops downwardly, extending to the floor. Excessive net material can collect on the floor. The net remains coupled to the pull-up chain 13.

Figure 4:
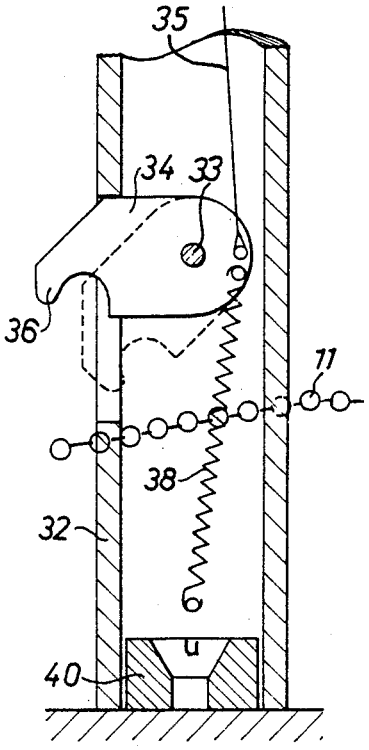
FIG. 4 is a fragmentary view of a support element with a net holding or retention latch.

To prevent flight of an attacker to be covered by the net, and to prevent the attacker from immediately and quickly lifting the net, pivotable latches 34 are preferably provided, located close to the floor structure, behind which the dropping net will hook in. The drop net 11 is looped over or guided adjacent to edge rods 32 which are located, spaced from each other, along the side walls of the protected space, secured, for example, by screws 40 to the floor. The rods are hollow; latches 34 are provided, retained by a weak spring 38 in a position shown in full lines in FIG. 4. They can pivot about a horizontal axis 33, and when the net 11 drops, latch 34 can pivot downwardly into the broken-line position and, as soon as it meets a space between the meshes of the net, will again pivot upwardly into the full-line position as shown in FIG. 4 under tension of the spring 38. If an attempt is made to raise the net, it will hook under the projecting nose 36. The latch element 36 is prevented from upward tipping. By a cable 35, passed through the hollow rod 32 the latches can all be unlatched or released upon pulling the cable 35, for example by an electromagnet, manually, or the like.

The drop net 11 is raised at a speed which can be readily controlled by rotating the rollers 18 at a controled speed, thus moving the pull chains 13 upwardly to pull the net into the position in which it is stretched or retained against the lower side of the ceiling elements 3. The dimensions of the drop net 11 are so selected that the transition from the drop net 11 to the raising chain 13 is, when the drop net is raised, preferably just below the holding or drop element 5. As soon as the drop element 5 then is moved in the position shown in FIG. 2, by the chain 13, the net 11 is retained in a tightly stretched position. The free run of the raising chain 13 can drop into the horizontal reception trough or rail or dish 17 and can be loosely retained therein. Thereafter, the rollers 18 can be reversed or released from a pulling force, so that roller chain elements 13 can collect in loose form as a collection supply, as shown at 11*a* in FIG. 2. Thus, the supply 11*a* may include part of the net, or only the pull-up chain or both. Retaing a supply of pull-up chain above the drop element 5 has the advantage that the weight of the pull-up chain assists in dropping the drop net, and no energy is required to rotate the rollers 18.

The sudden drop of the net 11, due to its own weight, completely covers people and objects within the protected space by the drop net 11. This is not only highly surprising to the people but, initially and quickly, they are rendered incapable of movement or taking action, nor can they flee. To re-store the drop net, and in order to start a motor for winding-up of the chain 13, it is necessary to operate an electrical supply switch for the motor.

In accordance with a feature of the invention, it is possible to drop the net only up to a portion of the height of the room, and then, after a short pause, release it completely. Simultaneously, upon triggering the release of the drop element 5, an alarm can be triggered, for example with an optical and acoustic warning or alarm element. Triggering of the net 11 can be done by an electrical switch or, otherwise, optically by photo cells, remote control, radio control, or triggered based on random movement, noise, shock, vibration or abnormal light. This is particularly important when used as a burglary protection device; various types of sensors, well known in the security field, can be used. It is also possible, of course, to use the sensors to trigger other warning or disabling elements.

Figure 2:
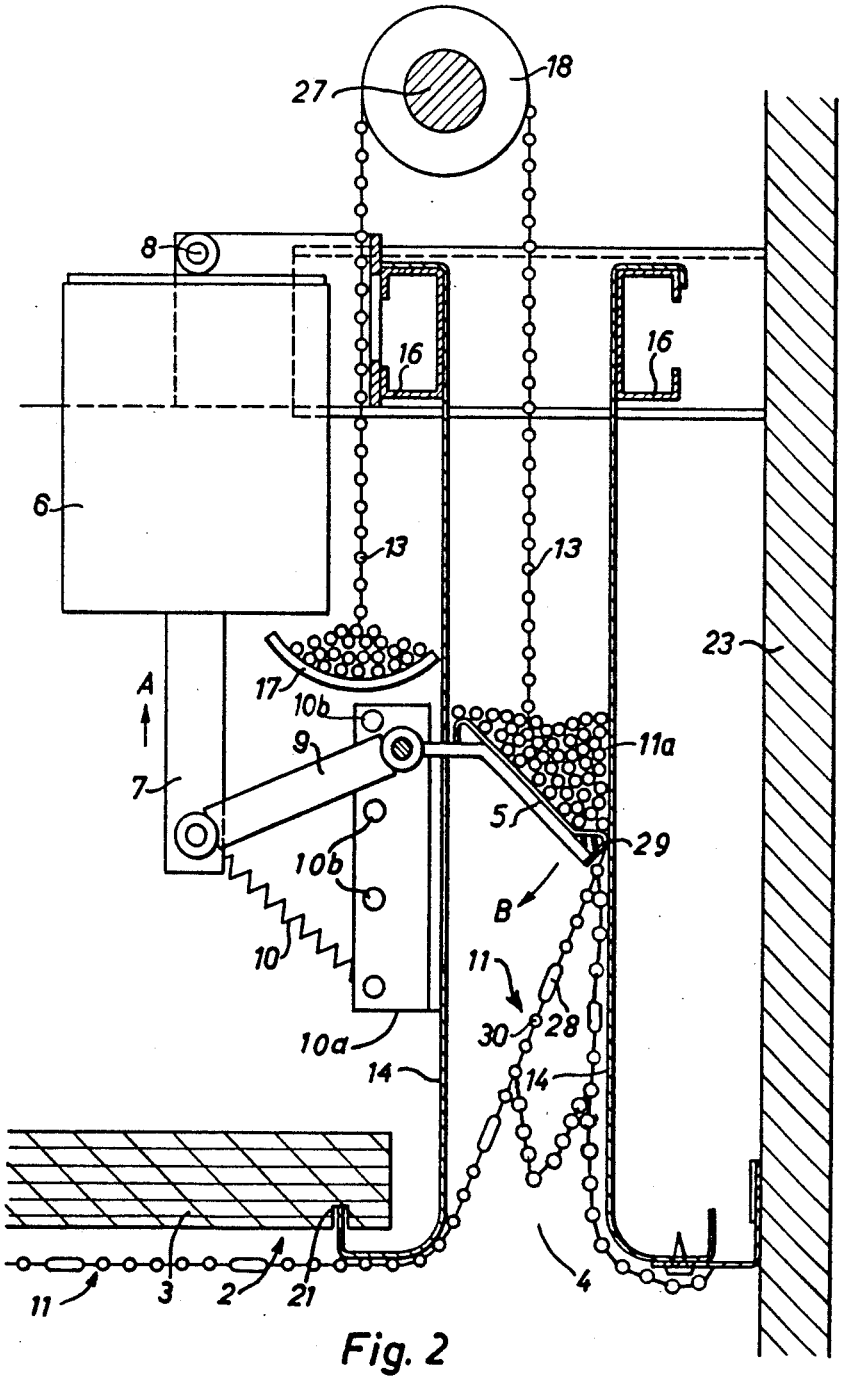
FIG. 2 is a highly schematic vertical view through a dropped ceiling structure with the net pulled upwardly.
Figure 5:
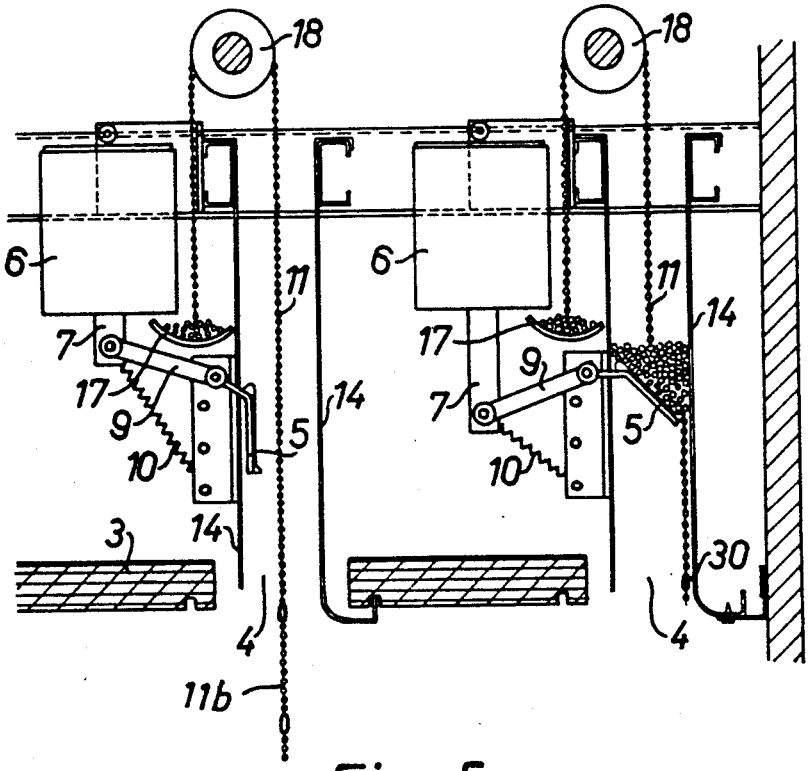
FIG. 5 is a schematic longitudinal part-sectional view through a dropped ceiling and illustrating another embodiment of the present invention.

FIG. 5 illustrates another embodiment of the invention, in which, rather than having one continuous drop net extending over the entire space, a plurality of drop nets 11*b* are provided, which, by holding arrangements similar to those shown in FIG. 2, form a plurality of vertical chain curtains or net curtains 11*b*. The same holding arrangements as previously described hold the respective curtains in bundled or gathered form behind or above a dropped ceiling 3; upon triggering of the solenoid mechanism, they are dropped in form of curtains and block escape or movement of persons 15 within the confined space. In contrast to the embodiment of FIG. 2, it is preferred that the entire drop net is retained above the drop element 5; in the embodiment of FIG. 2, the preferred form is such that only the chain 13 is placed in the zone 11*a* above the drop element 5. In all other respects, the arrangement is similar to that previously described. The left side of FIG. 5 illustrates the net 11 in dropped condition; the right side of FIG. 5 illustrates the same structure, with the net 11 in gathered condition above the drop element 5.

FIG. 2 illustrates a further feature; the retention spring 10 can be located along the bracket 10*a* on a plurality of selectable terminal pins 10*b*. The link 9 is somewhat longer than the horizontal spacing between the armature 7 and the bracket 10*a* so that, upon operation of the armature, a toggle effect will obtain, that is, as soon as the horizontal distance of the length of the link 9 is passed, the spring 10 can have a "snap action" to assist in rapid drop of the drop element 5 coupled to the link 9. The drop elements 5, after use, can be reset manually.

The space to be protected need not be confined or be within a building; the arrangement can be installed anywhere. For example, the protecting system and method can be used within the passenger compartment of a vehicle or an aircraft. The channels or ducts 4, and the operating elements for the drop net and the pull-up elements, for example the chain 13, can all be located within the double-ceiling structure customary in public service vehicles, aircraft and the like.

The term "attack" is used herein is deemed to include threatened attack, or attack which is deemed or believed to occur or which might occur.

Various changes and modifications may be made within the scope of the inventive concept.

I claim:

1. A system for enhancing or ensuring security against an attack in a defined space comprising a flexible net (11);

retaining means (5) for retaining the flexible net at a top region of the space;

pull-up or raising means (13) coupled to the flexible net;

a lifting mechanism (18) coupled to the pull-up or raising means for lifting the net towards the top region of the space and towards said retaining means (5);

a triggering or releasing mechanism (6, 9) coupled to the retaining means and abruptly releasing the flexible net for dropping into the space and covering an attacker in the space;

and wherein the upwardly confined space comprises a building structure having a dropped or double ceiling (2, 3); and wherein the retaining means (5) are located within the dropped or double ceiling.

2. The system of claim 1, wherein said double or dropped ceiling (3) is formed with essentially vertical spaces or ducts (4);

and wherein a portion of the drop net (11) is retained beneath the dropped or double ceiling (2, 3) in essentially stretched or taut condition, and another portion of the drop net is located in said vertical spaces or ducts in loose, bunched condition, and retained therein.

3. The system of claim 2, wherein said retaining means (5) selectively blocks and uncovers said vertical space;

and wherein a portion of said drop net (11) is retained in loose, bunched condition above said retaining means.

4. The system of claim 2, wherein said retaining means (5) selectively blocks and uncovers said vertical spaces;

and wherein a portion of the pull-up or raising means (13) are retained above said retaining means.

5. The system of claim 2, wherein said retaining means comprises a blocking rail or plate (5) pivotably located to block said vertical spaces or duct (4);

and wherein said triggering mechanism comprises electromagnetic means (6) and linkage means (9) coupling the electromagnetic means and said rail or plate for selectively blocking or releasing passage through said space or ducts in dependence on the state of energization of said electromagnetic means.

6. The system of claim 5, including spring means (10) coupled to the electromagnetic means and to said link means (9) and arranged to provide for toggle action upon movement of the link means due to change of state of energization of the electromagnetic means (6) and hence abrupt movement of said blocking rail or plate (5).

7. The system of claim 1, wherein the flexible net (11) comprises a plurality of vertical drop curtains positioned, when in quiescent or "ready" state, above said retaining means (5) in gathered form.

8. The system of claim 1, further including support elements (32) about which said flexible net (11) is guided;

and movable holding latches (34) located on said support elements and engageable within the mesh openings of the drop net to prevent lifting of the drop net after dropping thereof.

9. A method of enhancing or securing personal security against attack in a defined space, in which a flexible drop net (11) is secured to a ceiling structure of the space, comprising the steps of pulling up the net (11) by a pull-up means towards the ceiling structure of the space;

collecting and storing at least a portion of the net in loose, bunched condition above a drop element (5); and abruptly dropping said net over an attacker located in said space by abruptly releasing said drop element.

10. A system for enhancing or ensuring security against an attack in a defined space comprising a flexible net (11);

retaining means (5) for retaining the flexible net at a top region of the space;

pull-up or raising means (13) coupled to the flexible net;

a lifting mechanism (18) coupled to the pull-up or raising means for lifting the net towards the top region of the space and towards said retaining means (5);

a triggering or releasing mechanism (6, 9) coupled to the retaining means and abruptly releasing the flexible net for dropping into the space and covering an attacker in the space;

wherein said pull-up or raising means comprises a ball chain (13);

and wherein said lifting mechanism (18) comprises motor-driven rollers (18) about at least part of which said ball chain is looped.

11. The system of claim 10, including a retaining trough or dish (17) located downwardly from said rollers (18) for collecting and retaining portions of the ball chain (13) after having been looped about the rollers.

12. A system for enhancing or ensuring security against an attack in a defined space comprising a flexible net (11);

retaining means (5) for retaining the flexible net at a top region of the space;

pull-up or raising means (13) coupled to the flexible net;

a lifting mechanism (18) coupled to the pull-up or raising means for lifting the net towards the top region of the space and towards said retaining means (5);

a triggering or releasing mechanism (6, 9) coupled to the retaining means and abruptly releasing the flexible net for dropping into the space and covering an attacker in the space;

and wherein the flexible net (11) comprises a net structure formed of ball chains and includes a plurality of ball chain elements (30) and interconnecting nodal structures (28), movably connecting said ball chain elements in a mesh or net structure.

13. The system of claim 12, wherein said mesh structure comprises a mesh pattern formed of triangular or diamond-shaped mesh openings to provide for collapsing or gathering of said mesh structure upon application of tension by said pull-up or raising means (13), in at least one direction.

14. A system for enhancing or ensuring security against an attack in a defined space comprising a flexible net (11);

retaining means (5) for retaining the flexible net at a top region of the space;

pull-up or raising means (13) coupled to the flexible net;

a lifting mechanism (18) coupled to the pull-up or raising means for lifting the net towards the top region of the space and towards said retaining means (5), said lifting mechanism releasing at least a portion of the net to permit the net to accumulate in loose, bunched condition above the retaining means; and a triggering or releasing mechanism (6, 9) coupled to the retaining means (5) and abruptly releasing the flexible net retained above the retaining means for dropping into the space and covering an attacker in the space.

* * * * *